US006234442B1

(12) United States Patent
Huang

(10) Patent No.: US 6,234,442 B1
(45) Date of Patent: May 22, 2001

(54) COLLAPSIBLE EASEL WITH A PANEL STANDABLE ON AN UNEVEN GROUND

(76) Inventor: Chi-Ming Huang, P.O. Box 90, Tainan City (TW)

( * ) Notice: Subject to any disclaimer, the term of this patent is extended or adjusted under 35 U.S.C. 154(b) by 0 days.

(21) Appl. No.: 09/399,319

(22) Filed: Sep. 20, 1999

(51) Int. Cl.[7] ..... A47B 97/04

(52) U.S. Cl. ..... 248/464; 248/125.8; 248/148; 248/151; 211/195

(58) Field of Search ..... 211/195, 189, 211/203; 206/45.2, 45.24; 248/441.1, 464–465, 454–457, 463, 460, 528, 529, 125.8–125.9, 148–151, 188.5, 530

(56) References Cited

U.S. PATENT DOCUMENTS

| | | | | |
|---|---|---|---|---|
| D. 424,308 | * | 5/2000 | Hutten | D6/312 |
| 2,046,134 | * | 6/1936 | Ryang | 248/461 |
| 2,127,494 | * | 8/1938 | Tepper | 248/464 |
| 2,549,306 | * | 4/1951 | Geene | 206/45.24 |
| 2,638,300 | * | 5/1953 | De Jen | 248/464 |
| 3,145,014 | * | 8/1964 | Neuwirth | 248/464 |
| 3,145,966 | * | 8/1964 | Landon | 248/464 |
| 4,015,806 | * | 4/1977 | Cattermole | 248/168 |
| 4,609,174 | * | 9/1986 | Nakatani | 248/465 |
| 4,934,638 | * | 6/1990 | Davis | 248/464 |
| 5,125,613 | * | 6/1992 | Albee, Jr. et al. | 248/464 |
| 5,154,257 | * | 10/1992 | Mirles | 248/188.5 |
| 5,337,996 | * | 8/1994 | Kalish | 248/460 |
| 5,470,038 | * | 11/1995 | Clark | 248/156 |
| 5,950,979 | * | 9/1999 | Mira | 248/460 |
| 6,012,696 | * | 1/2000 | Borie | 248/461 |
| 6,050,531 | * | 4/2000 | Wilcox | 248/188.5 |

* cited by examiner

*Primary Examiner*—Daniel P. Stodola
*Assistant Examiner*—Jennifer E. Novosad

(57) ABSTRACT

A collapsible easel with a panel standable on an uneven ground includes an easel consisting of three tripod feet adjustable in length and collapsible to be contained in the panel consisting of two cover plates pivotally connected to each other. A first cover plate has a handle on an outer side and three position pivot bases in an inner wall of the outer side for pivotally connecting with upper ends of the tripod feet, which are separable to let them be contained in the first cover plate. Then the second cover plate is folded on the first cover plate to become a flat case having small dimensions and having light weight for transporting and storing. The tripod feet can be adjusted in length by means of a movable rod movably contained in each tripod foot. Thus the tripod feet can stand on an uneven ground by adjusting each tripod foot, and also can suit to different persons using this easel with a panel. Each tripod foot has a nail base nailed on the ground with a nail to prevent the easel with a panel from being blown down by a strong wind.

3 Claims, 8 Drawing Sheets

COLLAPSIBLE EASEL WITH A PANEL STANDABLE ON AN UNEVEN GROUND

BACKGROUND OF THE INVENTION

This invention relates to a collapsible easel with a panel being standable even on an uneven ground, particularly to one with an easel collapsible and contained in a panel and the panel consisting of two cover plates connected pivotally to be folded on each other to become a flat case having of a small dimensions and of a light weight for transporting, storing and carrying, possible to stand on an uneven ground, and having a nail base fixed under each foot of a tripod of the easel for keeping the easel from being blown down by a big wind.

A known conventional easel 10 shown in FIG. 1 supports a panel 11, on which a painting paper 12 is adhered. The conventional easel 10 is usually separated from the panel 11 made of a large plate, and the easel 10 is a tripod having three feet 100, 101, 102 pivotally connected with each other. Further, a lateral support plate 13 is fixed with the three feet 100, 101 and 102 for the panel 11 to rest on, having a not-short length and not a light weight.

However, the conventional easel 10 and the panel 11 are comparatively large and heavy, not occupying small dimensions in a car or a pick-up truck when they are transported. Whenever a person goes out for sketching, painting tools and pigments in addition to an easel, a panel and painting papers have to be carried out at the same time, not a taking a little time and work.

Besides, in outdoor sketching, if the easel 10 is not stably standing on the ground, it will be blown to fall down on the ground by a gust of wind. And the ground outdoors is often not smooth for the tripod feet 100, 101, and 102 of the easel 10 to stand stably, so bricks have to be laid under the feet for keeping the easel stable on the ground.

SUMMARY OF THE INVENTION

This invention has been devised to offer a collapsible easel with a panel standable on an uneven ground, collapsible to a small size and having a light weight to be easily carried out for painting, and possible to stand stably even on an uneven ground.

The main feature of the invention is a panel consisting of two cover plates pivotally connected to each other to be folded to become a flat case and a handle fixed on an upper side of a first cover base, three position pivot bases fixed on an inner wall of the upper side and having a bolt passing through each pivot base and screwed with a butterfly nut at an end. Further, an easel consists of three tripod feet pivotally connected to the three pivot bases of the panel, and a movable rod is movably contained in each tripod foot to adjust the length of the tripod feet respectively to stand on even a rough ground. Besides, a nail base is fixed on a lower end of each movable rod to be nailed in the ground to keep the easel from being blown down by a strong wind.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
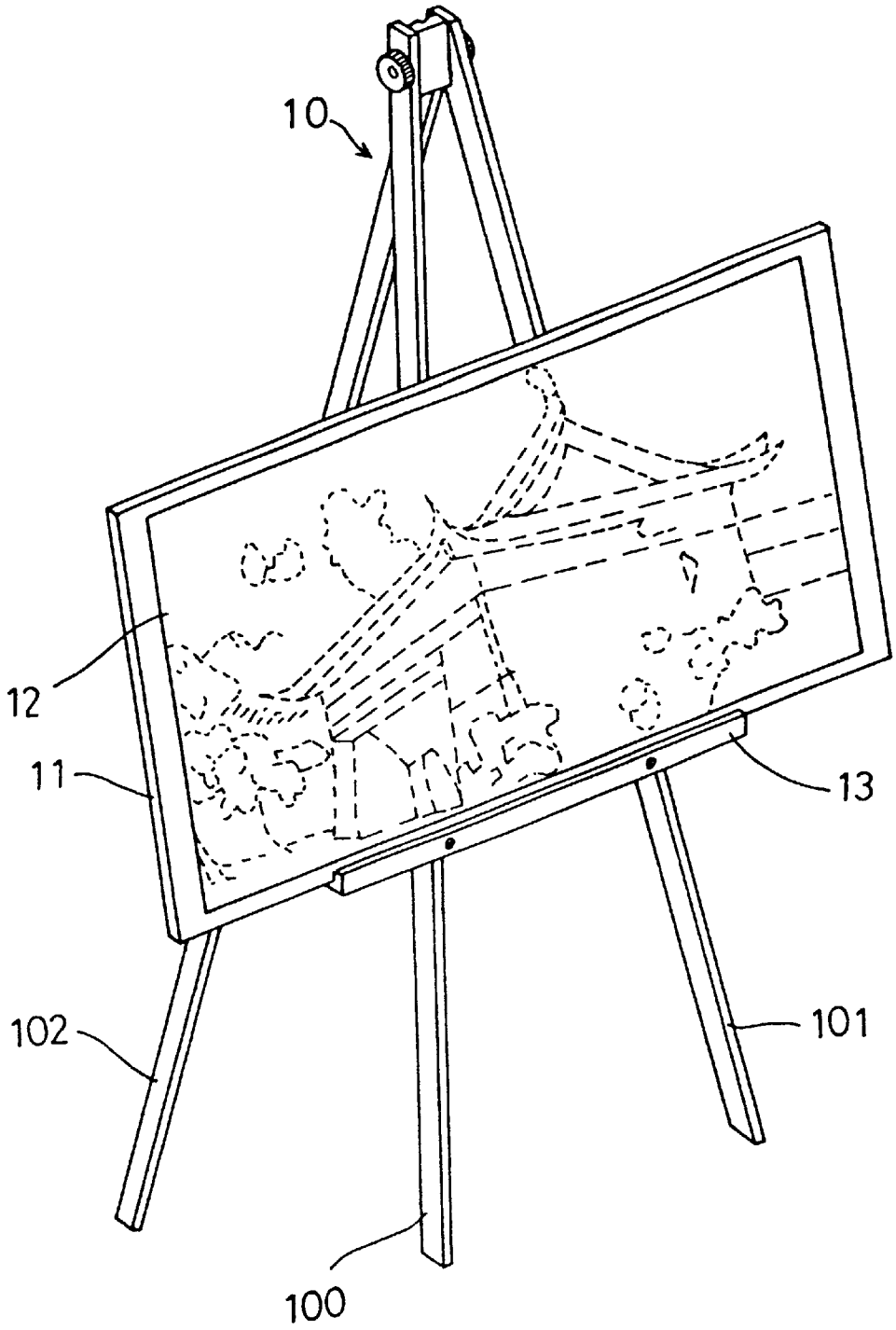
Fig. 1 (Prior Art)
FIG. 1 is a perspective view of a known conventional easel with a panel.
Figure 2:
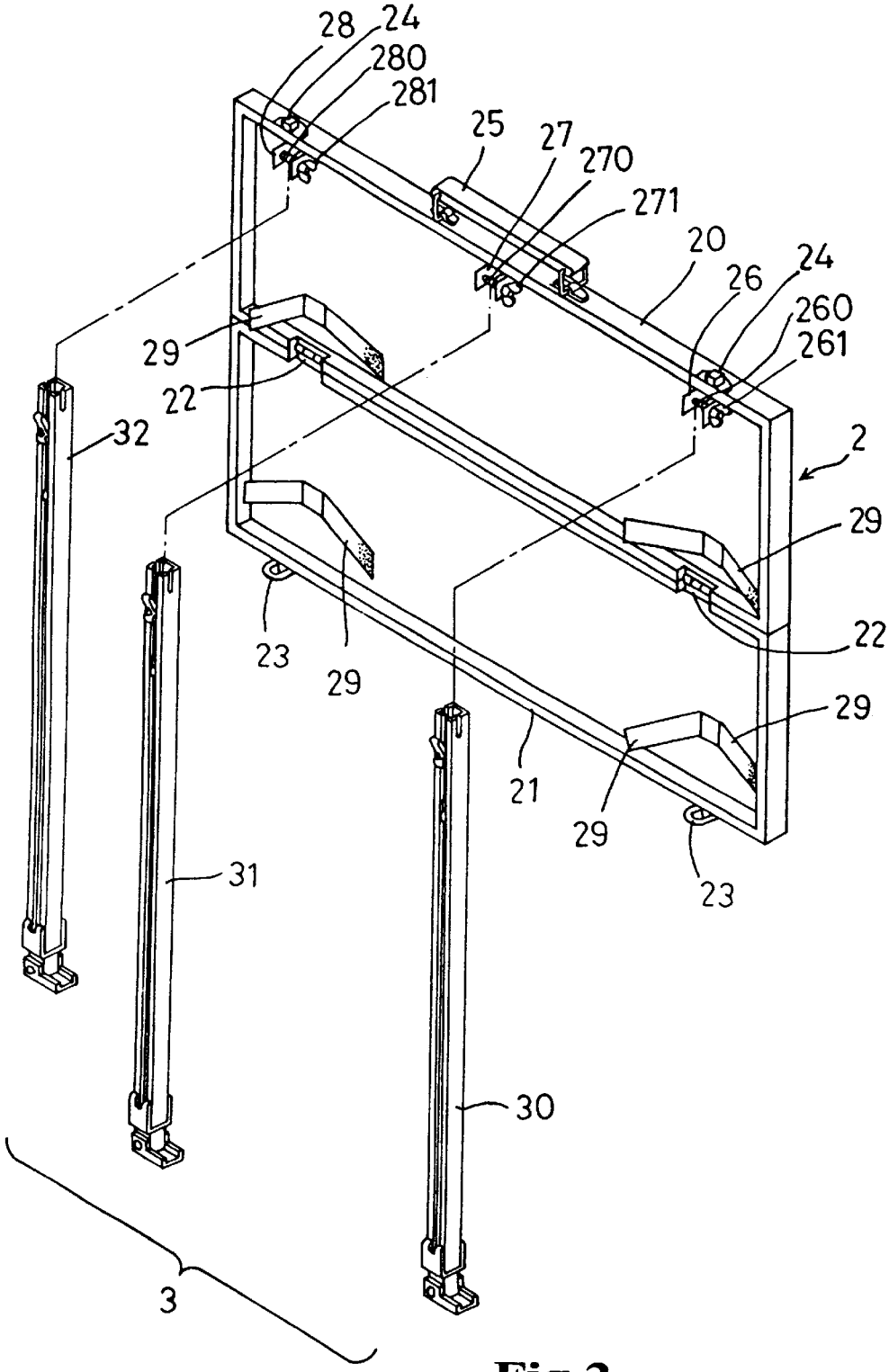
FIG. 2 is an exploded perspective view of a collapsible easel with a panel standable on an uneven ground in the present invention.

A preferred embodiment of a collapsible easel with a panel standable on an uneven ground in the present invention, as shown in FIG. 2, includes a panel 2 and an easel 3 combined collapsibly with each other.

The panel 2 is a collapsible flat case, having two cover plates 20 (a first), 21 (a second), which respectively have a lengthwise side pivotally connected with two pivots 22, an engage ring 23 near two ends of a lower side of the second cover plate 21 and two hook means 24 near two ends of the upper side of the first cover plate 20 to correspond to the two engage rings 23. The first cover plate 20 has a handle 25 fixed on an middle section of the upper side, three position pivot bases 26, 27 and 28 fixed spaced apart equidistantly on an inner wall of the upper side, a bolt 260, 270, 280 respectively fitting through the three pivot bases 26, 27 and 28, a butterfly nut 261, 271, 281 respectively screwing with the end of the three bolts 260, 270, 280. Further, two Velcro bands (a hook and loop fasteners) 29 are provided on the proper locations of the inner wall of the two cover plates 20, 21, just facing the two pivot bases 26 and 28.

Figure 3:
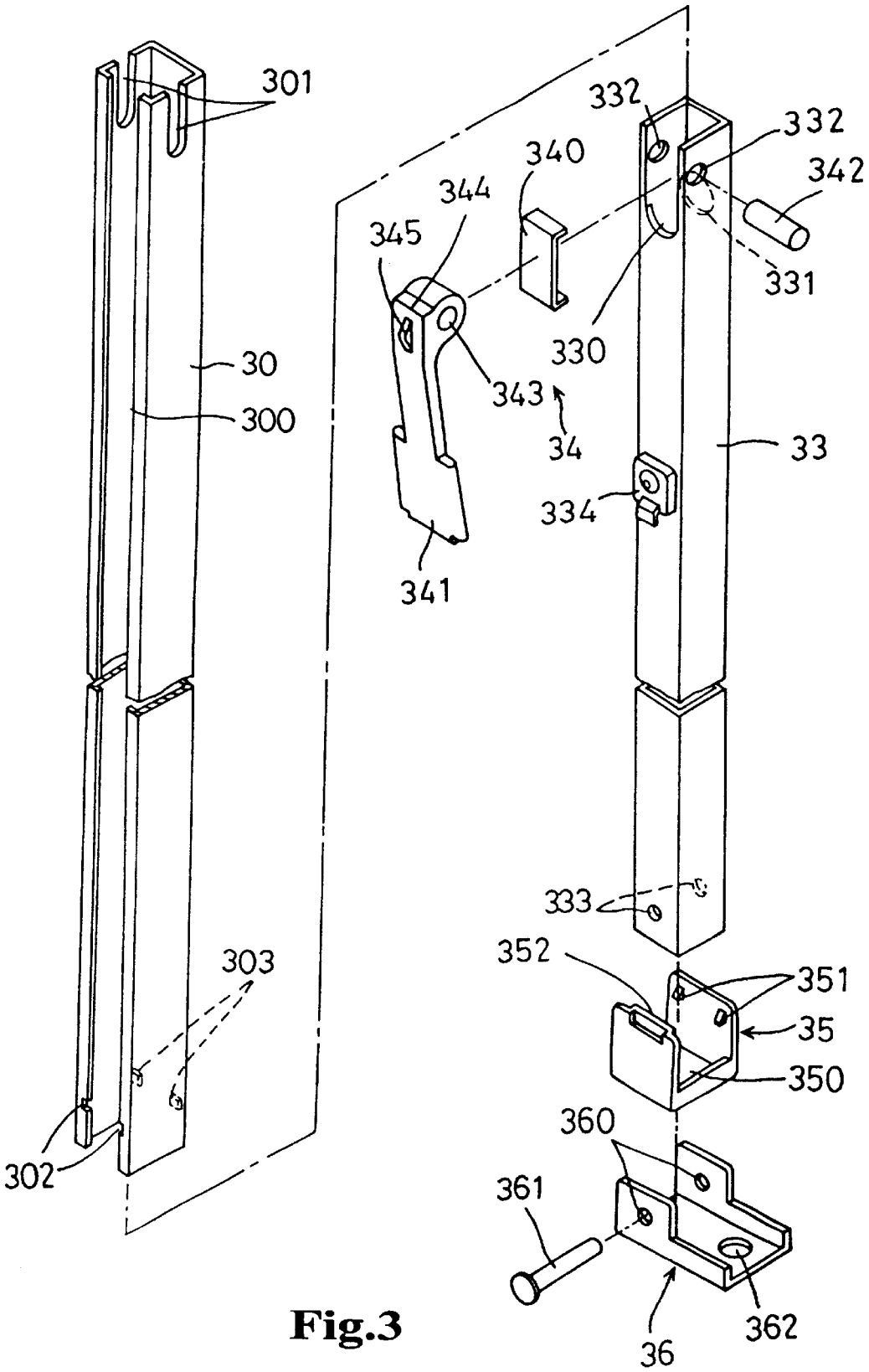
FIG. 3 is an exploded perspective view of a tripod foot of the easel in the present invention.

The easel 3 is pivotally connected to the inner wall of the panel 2, having three tripod feet 30, 31, and 32. The tripod feet 30, 31 and 32 are respectively connected pivotally to the three position pivot bases 26, 27 and 28, having respectively the same structure as shown in FIG. 3.

Each tripod foot 30, 31, and 32 has a hollow interior, a slide aperture 300 in one vertical side, a slot 301 formed respectively in two opposite side walls of an upper end for one of the three bolts 260, 270, 280 to insert therein, two notches 302 formed in the two sides of the lower end of the slide aperture 300, two recesses 303 formed spaced apart in the lower end of the wall opposite to the slide aperture 300.

Further, a movable rod 33 is provided movable in each tripod foot 30, 31, 32, having an opening 330 formed in one side of the upper end, a hole formed in the wall opposite to the opening 330, a pivot hole 332 formed each in the two opposite walls of the upper end, a hole 333 formed each in the two opposite wall of the lower end, a stopper 334 fixed on one side of an intermediate section below the opening 330.

Further, a position unit 34 is provided to be located at the upper end of each movable rod 33, consisting of a stop plate 340, a press plate 341 and a pivot 342. The stop plate 340 is shaped as U, the press plate 341 has a pivot hole 343 in an upper portion, a press face 344 formed to protrude from the upper portion, and a projection 345 on a side wall of the upper portion.

Further, a stop member 35 is provided to fit around the lower end of each tripod foot 30, having an opening 350 between two opposite (a front and a rear) side walls for the lower end of each movable rod 33 to extend through, two insert studs 351 on the front and the rear wall, and a projection 352 formed on an inner side of the front wall and having the same width as the slide aperture 300 of each tripod foot 30.

Next, a nail base 36 is provided to be fixed with the lower end of the movable rod 33, having lateral holes 360 each aligned in two opposite walls for a rivet 361 to pass through and further through the holes 333 of the movable rod 33, and a nail hole 362 in the bottom of the nail base 36.

Figure 4:
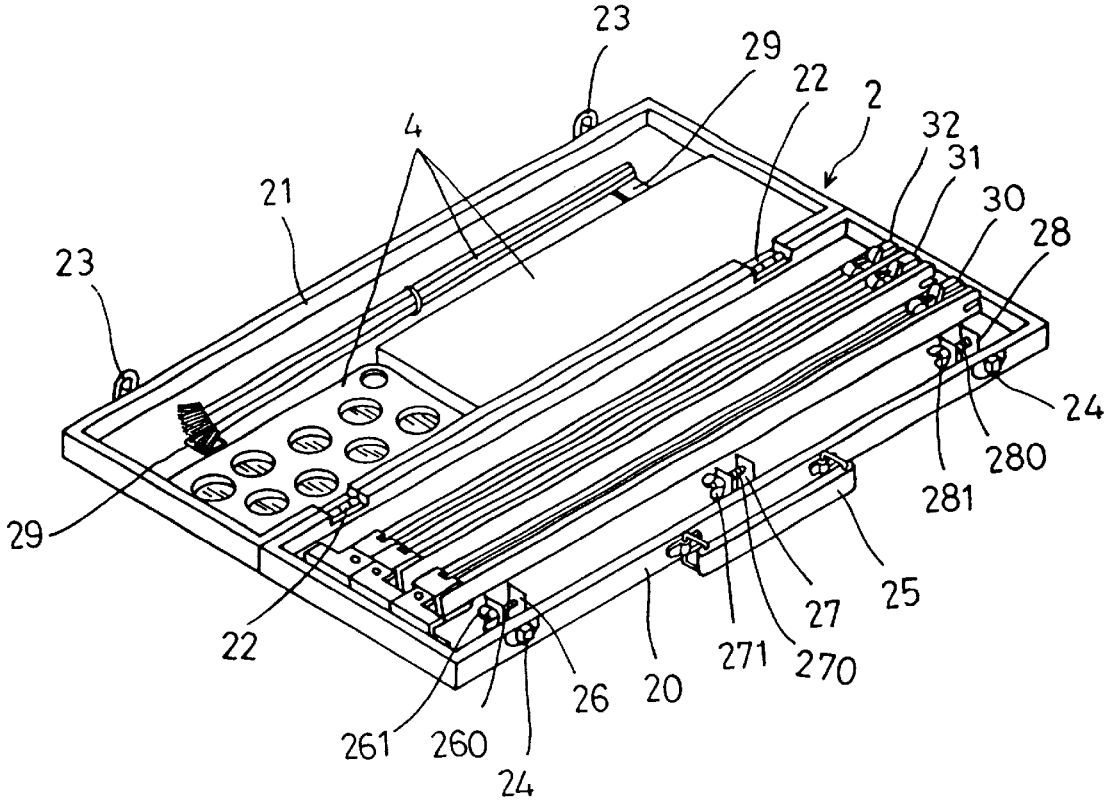
FIG. 4 is a perspective view of the collapsible easel with a panel standable on an uneven ground in the half collapsed condition in the present invention.
Figure 5:
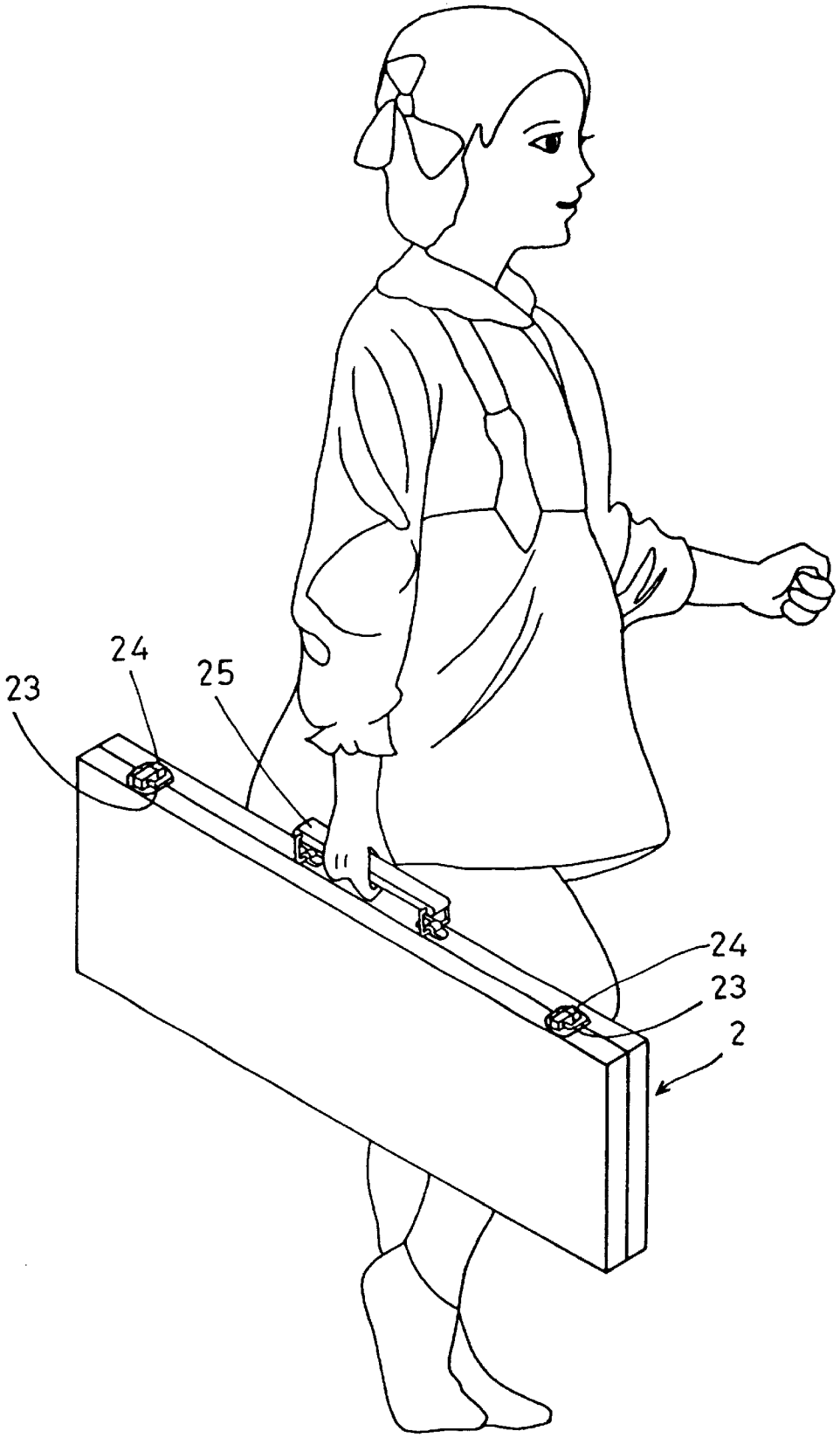
FIG. 5 is a perspective view of the collapsible easel with a panel standable on an uneven ground in the collapsed condition in the present invention and carried in a hand of a person.

In assembling, as shown in FIGS. 2, 3 and 4, firstly, the three tripod feet 30, 31 and 32 of the easel 3 are combined together by placing the stop plate 340 of the foot 30 in the upper end of the movable rod 33, letting one end of the stop plate 340 located at the upper end of the movable rod 33 and the other end located in the hole 331. Then the press plate 341 has its upper end placed in the opening 330 of the movable rod 33, with the pivot hole 343 aligned to the shaft holes 332 for a pivot 342 to extend therein to pivotally connect the press plate 341 with the movable rod 33. Thus, the position unit 34 is finished in assembling. Then the movable rod 33 together with the position unit 34 is inserted in each tripod foot 30, 31, 32, and the press plate 341 may move up and down along the slide aperture 300 together with the movable rod 33. Then each stop member 35 is fitted around the lower end of each tripod foot 30, 31, 32, permitting the lower end of the movable rod 33 to pass through to let the movable rod 33 slide down. The insert studs 351 of the stop member 35 engage the recesses 303 of each tripod foot 30 and the notches 302, with the projection 352 just fitting in the slide aperture 300 for stopping the stopper 334 of the movable rod 33 so as to prevent the movable rod 33 from moving out of the tripod foot 30. Finally, the tripod feet 30, 31 and 32 assembled with the three movable rods 33, the position units 341, the stop members 35 and the nail bases 36 are placed in the first cover plate 20 as shown in FIG. 4. Painting tools 4 and pigments are placed in the second cover plate 21. Then the two cover plates 20, 21 are folded on each other, engaging the engage rings 23 with the hook means 24, becoming a flat case as shown in FIG. 5 for carrying. Then the collapsed easel 3 with the panel 2 has small dimensions and a light weight for a hand to grip the handle 25 for carrying, very convenient.

Figure 6:
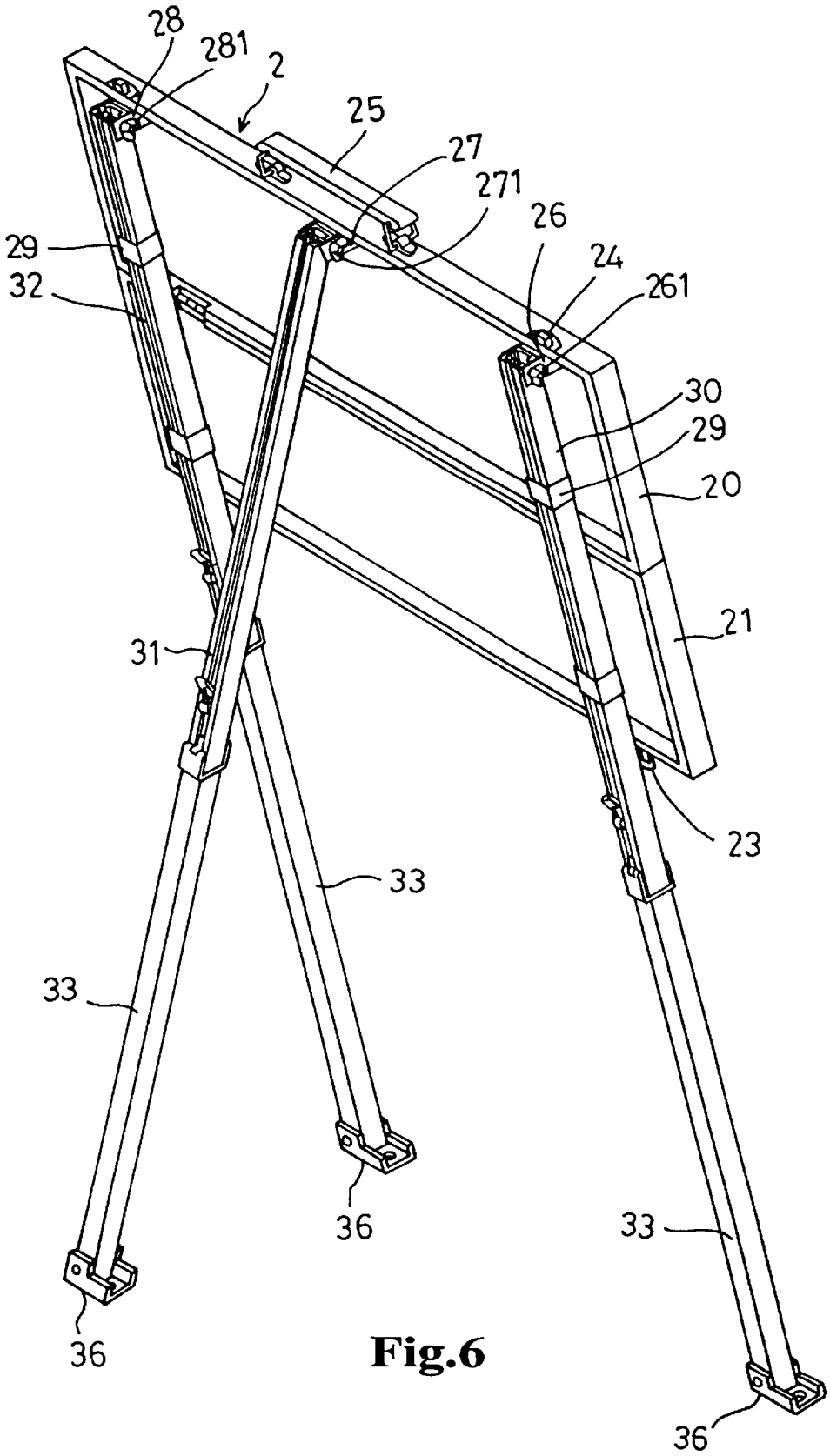
FIG. 6 is a perspective view of the collapsible easel with a panel standable on an uneven ground extended for use in the present invention.

In using, as shown in FIG. 6, disengage the two engage rings 23 from the hook means 24 of the two cover plates 20, 21, and swing open the cover plates 20, 21 to let them become a flat panel 2. Then the slot 301 of each tripod foot 30, 31, 32 is passed through by the bolt 260, 270 or 280 so that each foot 30, 31, 32 may be rotated for a preset angle to extend outward with the bolt 260, 270 or 280 of the position pivot base 26, 27, 28 functioning as a pivot. The two outside tripod feet 30, 32 are closely positioned with the panel 2, and kept immovable by the two Velcro bands (a hook and loop fasteners) 29 bound on them. The middle tripod foot 31 is pulled to swing outward to form three fulcrum points of a triangle, and then the butterfly nuts 261, 271, 281 are screwed tightly to force the two side walls of the position pivot bases 26, 27, 28 clamp tightly the tripod feet 30, 31, 32. Then the panel 2 can be supported by the two side tripod feet feet 26, 28. Next, the height of the easel 3 is adjusted by pulling down the three movable rods 33 in the tripod feet 30, 31, 32 according to the height of a user, (painter), letting the panel 2 located at a proper height for painting. The movable rods 33 can be adjusted to be pulled out of the feet 30, 31, 32 in different length in accordance with the condition of the ground where the easel 3 is placed, making the panel 2 in a a horizontal condition, without need of using bricks or wood blocks under the tripod feet.

Figure 8:
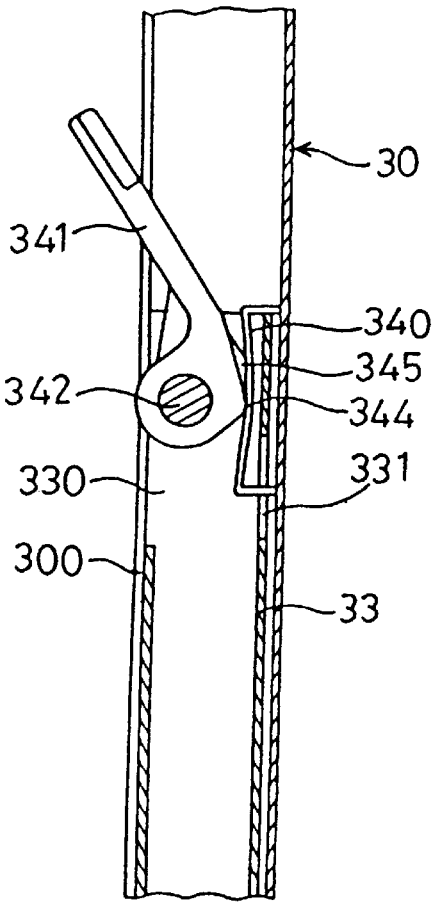
FIG. 8 is a cross-sectional view of the tripod foot locked with the movable rod in the present invention; and, FIG. 9 is a perspective view of the collapsible easel with a panel extended for use on an outdoor ground in the present invention.
Figure 7:
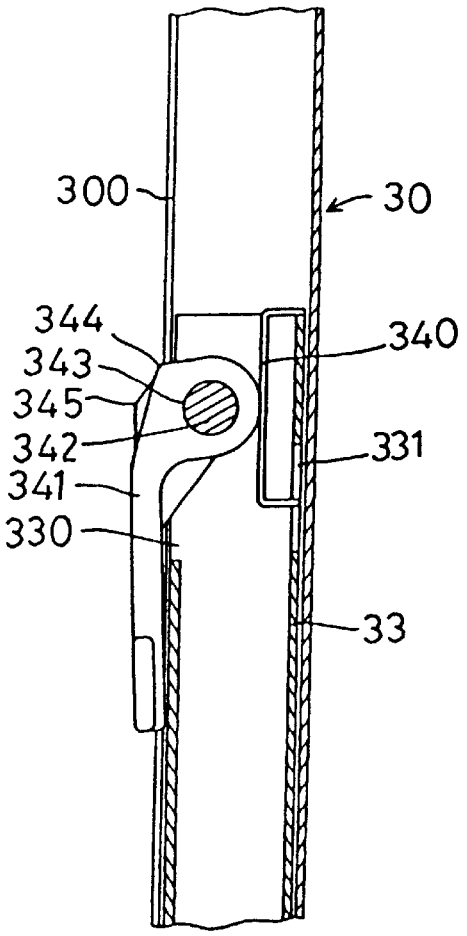
FIG. 7 is a cross-sectional view of a tripod foot unlocked from a movable rod in the present in the present invention.
Figure 9:
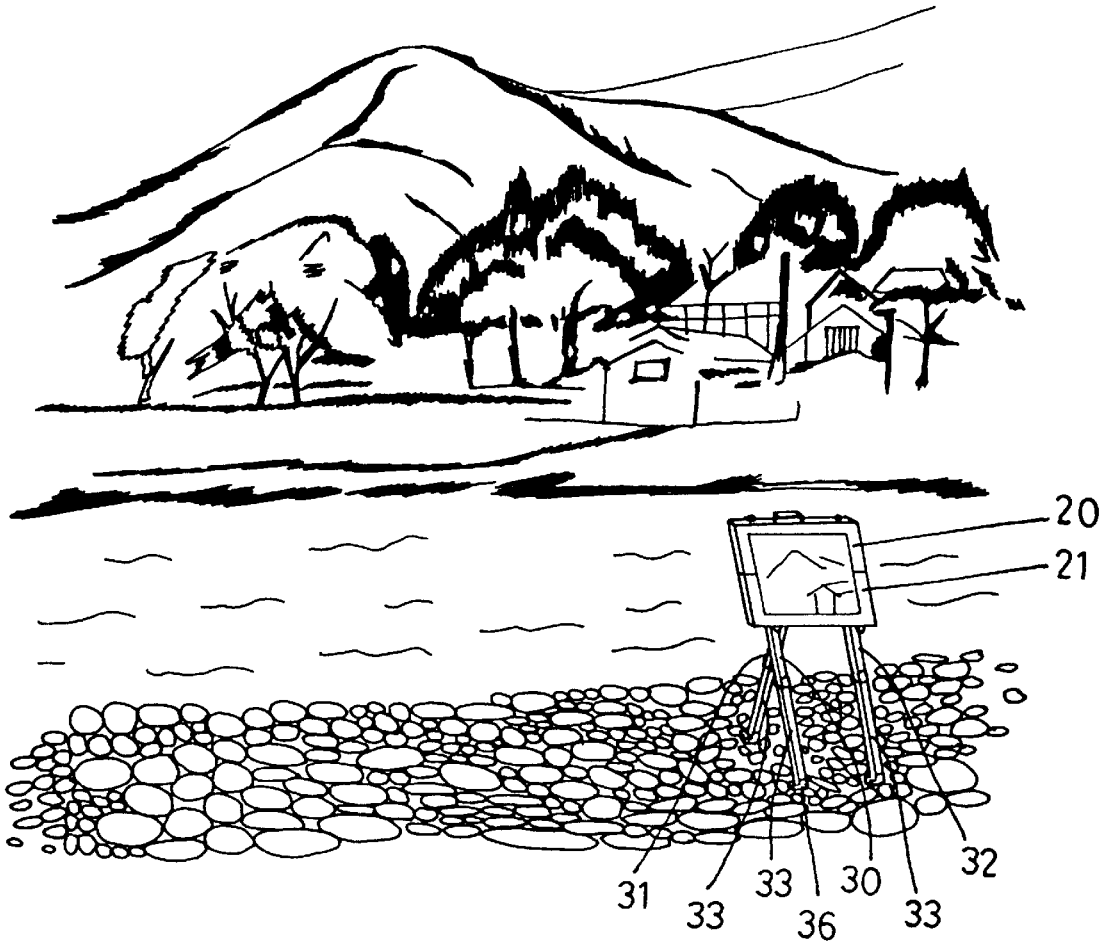

Adjusting the height of the movable rods 33 is very simple, by pressing down the press plate 341 as shown in FIG. 7, letting the press face 344 and the projection 345 separate from the stop plate 340, which then loosens the inner walls of the tripod foot 30. Then the tripod foot 30, the stop plate 340 and the movable rod 33 may not engage with each other tightly, with a gap formed between. Then the movable rod 33 can be pulled outward (down) or inward (up) in the tripod foot 30, adjusted to a proper location to get the whole height suitable for the panel 2 to be painted. Then the press plate 341 is pulled up as shown in FIG. 8, with the press face 344 pressing the stop plate 340, which then has its two ends closely rest against the inner walls of the tripod foot 30. Further, the projection 345 of the press plate 341 presses the stop plate 340, forcing the movable rod 33 to tightly engage the tripod foot 30 to become immovable. Thus, the three tripod feet 30, 31, 32 are adjusted to have a proper height by means of the movable rods 33, possible to stand stable even on an uneven ground outdoors, as shown in FIG. 9. Should there be a strong wind, the nail bases 36 under the lower end of the movable rods 33 can be nailed on the ground with nails passing through the nail hole 362. Then the tripod feet 30, 31, 32 are kept stable, never falling down, and in addition, the panel 2 has the three position pivot bases 26, 27 and 28, pivotally connected to the easel 3, never separating from the easel 3.

This invention has the following advantages, as can be understood from the aforesaid description.

1. The easel can be collapsed and placed in the panel, which then can be folded into a flat case of a small dimensions, of light weight, occupying a small space for transporting and storing, and handy for carrying out for sketching.

2. The tripod feet of the easel can be adjusted in their height to suit to different persons, standable on an uneven ground, keeping the panel horizontal, overcoming inconvenience of using the easel on rough condition outdoors, and needing no bricks or wood blocks for stabilizing the easel on the ground.

3. The tripod feet of the easel have respectively the nail base for nailing it on the ground to keep the easel from being blown down by a strong wind, if necessary.

While the preferred embodiment of the invention has been described above, it will be recognized and understood that various modifications may be made therein and the appended claims are intended to cover all such modifications which may fall within the spirit and scope of the invention.

What is claimed is:

1. A collapsible easel with a panel which is standable on an uneven ground, comprising:

a panel consisting of first and second cover plates pivotally connected to each other, and capable of being folded into a flat case, said first and second cover plates respectively having hooking means on an outer side for hooking to each other, said first cover plate having a handle on a middle section of one of the outer sides for carrying, and three position bases fixed and spaced apart equidistantly on an inner wall of the first cover plate, each said position base having a bolt passing therethrough, each said bolt is screwed with a butterfly nut to loosen or tighten said position base;

an easel consisting of three tripod feet, each of said tripod feet having an upper end pivotally connected to a respective one of said position bases of said panel, a movable rod contained in each of said tripod feet and upwardly and downwardly movable therein, and a nail base fitted around a lower end of each of said movable rods; and, said tripod feet can be separated from said panel and placed parallel and lengthwise inside said first cover plate of said panel, said panel can be folded with said second cover plate on said first cover plate, each of said tripod feet respectively adjustable in height according to the height of a user and with an uneven ground for standing said easel on the ground, said panel can therefore be kept horizontal, said nail bases under each of said tripod feet can be nailed on the ground to prevent said easel, from being blown down by a strong wind.

2. The easel with a panel standable on an uneven ground as claimed in claim 1, wherein said first and second cover plates are further provided with two hook and loop fasteners fixed on an inner side and corresponding to said two outer position bases of said first cover plate, said fasteners binding on said two outer tripod feet when said tripod feet are extended for use.

3. The easel with a panel standable on an uneven ground as claimed in claim 1, wherein said tripod feet each have a hollow interior, a lengthwise slide aperture in one side, a slot formed respectively in two opposite sides of the upper end and aligned to each other for said bolt of each of said position bases of said first cover plate to fit therein, a stop member fitted on a lower end of each of said tripod feet, said movable rod respectively placed in each of said tripod feet, each said movable rod having an opening in a side of an upper end, a hole bored in an opposite side of said opening, a pivot hole respectively bored in two opposite sides of the upper end of said movable rod, a stopper fixed on an intermediate section of the side with said opening, a position unit combined with the upper end of said movable rod for pressing tightly or loosening the upper end of each said movable rod when said movable rod is pushed up or pulled down, and said position unit consisting of a stop plate, a pressing plate and a pivot.

* * * * *